United States Patent [19]

Wright et al.

[11] 4,176,414

[45] Dec. 4, 1979

[54] SOFA-SLEEPER

[75] Inventors: Ronald E. Wright, Jasper, Mo.; Ronald J. Kennedy, Ennis, Tex.; Sidney A. Hiatt, Joplin, Mo.

[73] Assignee: Leggett & Platt, Incorporated, Carthage, Mo.

[21] Appl. No.: 890,366

[22] Filed: Mar. 27, 1978

[51] Int. Cl.[2] ..... A47C 17/13

[52] U.S. Cl. ..... 5/13; 5/51 R; 5/187; 5/471

[58] Field of Search ..... 5/13, 51 R, 127, 203, 5/186 B, 187, 322

[56] References Cited

U.S. PATENT DOCUMENTS

| | | | |
|---|---|---|---|
| 1,959,920 | 5/1934 | Kaiser | 5/322 |
| 2,878,490 | 3/1959 | Schneider | 5/51 R |
| 3,188,660 | 6/1965 | Guttman | 5/91 |
| 3,245,091 | 4/1966 | Spitz | 5/51 R |
| 3,482,270 | 12/1969 | Hill | 5/187 |

*Primary Examiner*—Casmir A. Nunberg

*Attorney, Agent, or Firm*—Wood, Herron & Evans

[57] ABSTRACT

An improved sofa-sleeper structure having a foldable bed frame, the bed frame including a cloth front deck and a cloth rear deck. The cloth decks are fixed one to the other, e.g., by stitching, at their adjoining edges, and are attached by tension springs to the bed frame. A tensioning device extends between side members of the bed frame in the area where the front and rear decks are fixed together, the tensioning device maintaining the front deck relatively taut when the bed frame is folded into the sofa attitude, thereby aiding in establishing a spring surface for the sofa's cushions. A mattress is connected to the cloth front and rear decks in fixed fashion around its periphery, e.g., by stitching, thereby stabilizing the mattress in position on the bed frame.

7 Claims, 5 Drawing Figures

SOFA-SLEEPER

This invention relates to sofa-sleepers. More particularly, this invention relates to an improved sofa-sleeper structure.

Sofa-sleepers are well known to the prior art. Basically, a sofa-sleeper includes a foldable bed frame that supports a mattress. The sofa-sleeper is adapted for use as a sofa when the bed frame is folded up into a storage attitude within the sofa framework to permit use of the structure as a seating surface. The sofa-sleeper also can be used as a bed when the bed frame is extended from the storage attitude into a generally horizontal bed attitude to permit use of the structure as a sleeping surface. One such prior art sofa-sleeper is that illustrated in U.S. Pat. No. 3,954,153, issued Dec. 17, 1974, and assigned to the assignee of this application.

Those sofa-sleeper structures known to the prior art, as far as we are aware, always have included a wire mesh or wire grid attached to the foldable bed frame. This wire grid was either extended for the full length of the foldable bed frame or for the major portion of the length, the remainder being made from cloth, as disclosed in Schneider U.S. Pat. No. 2,878,490. This wire grid, or wire and cloth grid, is generally connected with the side and at least one end member of the bed frame by a plurality of tension springs, so that the grid remains taut and partially resilient when the frame is unfolded for use as a bed.

Whether made from wire only, or from wire and cloth, and irrespective of size mattress employed, the sleeping surface of a sofa sleeper has always been considered to be a compromise and less satisfactory than a bed. Principally, the failing of a sofa-sleeper as a sleeping surface was attributable to sag in the wire grid when a person was resting prone on top of the unfolded bed. The wire just could not be made taut enough if the unit was foldable to prevent that sag.

It has been a primary objective of this invention to provide a new sofa-sleeper having a foldable bed frame and mattress support which overcomes or greatly relieves the sag heretofore experienced in wire grid style mattress supports of sofa-sleepers.

It has been another objective of this invention to provide an improved sofa-sleeper structure in which the front and rear decks are fabricated of a cloth fabric, and in which a mattress is fixed in place, e.g., by stitching, on those front and rear cloth decks around the periphery of that mattress, thereby preventing undue shifting of the mattress when the bed frame is folded up from the bed attitude to the sofa attitude, and thereby insuring the mattress will be properly positioned on the bed when the bed frame is unfolded from the sofa attitude to the bed attitude.

It has been still another objective of this invention to provide an improved sofa-sleeper structure in which the mattress attached front and rear decks are structured of a cloth fabric, the front cloth deck cooperating with a tensioning device to draw the front cloth deck into a taut relation relative to the bed frame when the bed frame is folded into the sofa attitude for defining a spring like surface for the sofa's cushions and for establishing a discrete front edge for that spring like surface.

In accord with these objectives, the improved sofa-sleeper of this invention comprises a foldable bed frame, the bed frame including a cloth front deck and a cloth rear deck. The cloth decks are fixed one to the other, e.g., by stitching, at their adjoining edges, and are attached by tension springs to the bed frame. A tensioning device extends between side members of the bed frame in the area where the front and rear decks are fixed together, the tensioning device maintaining the front deck relatively taut when the bed frame is folded into the sofa attitude, thereby aiding in establishing a spring surface for the sofa's cushions. A mattress is fixedly connected to the cloth front and rear decks around the periphery of the decks, e.g., by stitching, thereby stabilizing the mattress in position on the bed frame.

Other objectives and advantages of this invention will be more apparent from the following detailed description taken in conjunction with the drawings in which:

FIG. 3A is an enlarged cross-sectional view of that structural portion encircled in FIG. 3.

Figures 1, 1A:
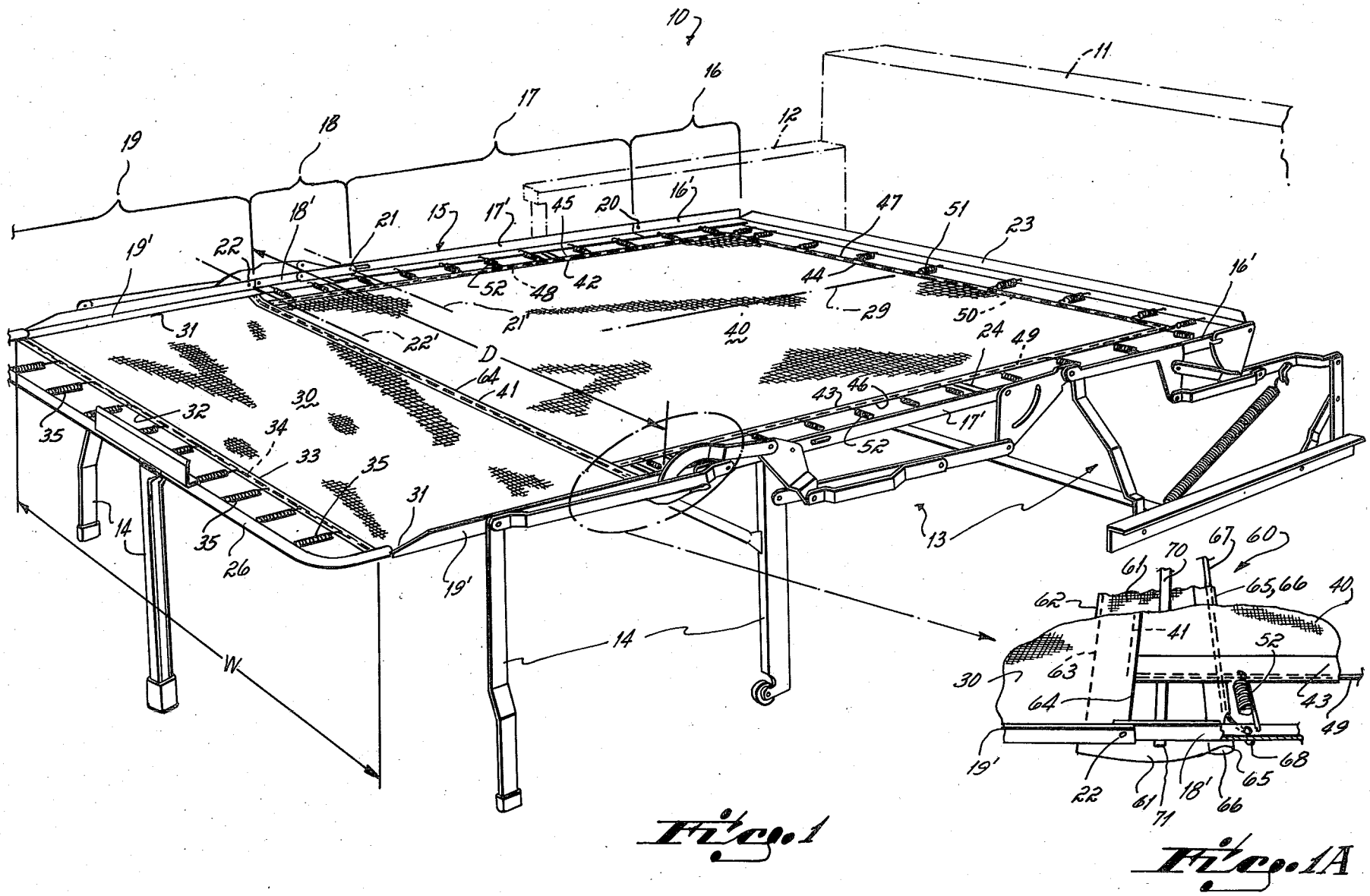
FIG. 1 is a perspective view illustrating an improved sofa-sleeper in accord with principles of this invention, and showing the bed frame in a horizontal or bed attitude.
FIG. 1A is an enlarged view of that structural portion encircled in FIG. 1.

The combination sofa-sleeper fixture 10 is illustrated as being mounted upon a framework of an upholstered sofa which has backrest cushion 11 and sofa arms 12. The sofa framework does not form any part of the invention of this application, and may comprise any well-known standard upholstered frame construction.

The sofa-sleeper 10 structure comprises foldable bed frame 15 attached to a wooden frame (not shown) of the sofa. The foldable bed frame 15 of the fixture includes pivotally interconnected bed frame head section 16, body section 17, intermediate section 18 and foot section 19, the pivotal connections being indicated at 20, 21 and 22, respectively. The foot section 19 of the bed frame 15 is hereinafter referred to as the front deck section of the bed frame, and the head 16, body 17 and intermediate 18 sections of the bed frame 15 are hereinafter referred to as the rear deck section of the bed frame. Substantially parallel side frame rails 16', 17', 18' and 19' of these bed sections 16, 17, 18 and 19 may be made of any suitable metal shape such as angle iron. The side frame rails 16' of the head section 16 are connected by a transverse head rail 23. The side frame rails 17', 18' of the body section 17 and the intermediate section 18 are interconnected by downwardly offset transverse cross tie rails 24, 25, and the side rails 19' of the foot section 19 are interconnected by a transverse foot rail 26. The bed frame 15 is supported in the horizontal or bed configuration illustrated in FIG. 1 by a plurality of foldable legs 14. Further, the bed frame 15 is connected, through head section 16, by linkage structure 13 (only part of which is shown) with framework (not shown) of the upholstered sofa 10. A linkage structure particularly useful with the bed frame 15 is set forth in detail in U.S. Pat. No. 3,854,153, assigned to the assignee of this application, the disclosure of that patent being incorporated herein by reference. The linkage structure disclosed in U.S. Pat. No. 3,854,153 is especially adapted to translate the bed frame 15 between the horizontal or bed attitude shown in FIG. 1 and the folded or sofa attitude shown in FIG. 3.

The front deck 30 of bed frame 15 is comprised of a cloth fabric or sheet, e.g., woven or nonwoven polypropylene, and is connected to front bed frame 19 of the bed frame 15. The cloth fabric deck 30 is attached at opposite side edges 31 in fixed fashion to side frame rails 19'. The front deck 30 is provided along its forward edge 32 with a sleeve 33 that receives a metal rod 34 therethrough, that rod not being attached to the side frame rails 19'. A plurality of spaced tension springs 35, longitudinally disposed (relative to the bed frame's longitudinal axis 29), are each connected at one end to the foot rail 26 of the bed frame's foot section 19, and are each connected at the other end to the metal rod 34. These tension springs 35 at the forward edge 32 of the front deck 30 cooperate with other structure to establish the front deck in a generally taut attitude when the bed frame 15 is in the bed attitude shown in FIG. 1 or in the sofa attitude, partially shown in FIG. 3.

The rear deck 40 of the bed frame 15 is also comprised of a cloth fabric or sheet, e.g., woven or nonwoven polypropylene, and is connected to rear bed frame section 16–18 of the bed frame 15. The front edge of the rear deck 40 is stitched to the rear edge of the front deck along transverse stitch line 41. Note the rear deck 40 is narrower in width than the front deck 30 and, therefore, is spaced from side rail 16'–18' of the bed frame 15. A sleeve 42–44 is provided along each side 45 and 46 and rear 47 edges of the rear deck 40, each of these sleeves receiving metal rod 48–50 not connected to the bed frame. At the head of the bed frame 15, a plurality of tension springs 51 are longitudinally disposed relative to the frame's axis 29, are each connected at one end to the head rail 23 of the bed frame's head section 16, and are each connected at the other end to the metal rod 50. Along each side of the head section 16, body section 17 and intermediate section 18 of the bed frame 15, a plurality of tension springs 52 are transversely disposed relative to the frame's axis 35, are each connected at one end to the respective side rail 16'–18', and are each connected at the other end to metal rod 48 or 49. Thus, and as particularly shown in FIG. 1, the front cloth deck 30 of the bed frame 15 is fixedly connected to the bed frame's foot section 19 along its frong edge 32, and is fixedly connected along its rear edge to the rear cloth deck 40 as at stitch line 41. The rear cloth deck 40 is stitched to the front cloth deck 30 along its front edge as at stitch line 41, and is spring 51, 52 connected to the bed frame's head 16, body 17 and intermediate 18 sections along side rails 16–18 and head rail 23.

A tensioning device 60 is positioned adjacent the stitch line 41 for maintaining tautness of the front deck when the bed frame 15 is in the sofa attitude, thereby aiding in establishing a spring surface for the sofa's cushions (not shown). The tensioning device 60 is particularly illustrated in FIGS. 1 and 1A, and includes a cloth fabric or sheet flap 61 (also, e.g., of woven or nonwoven polypropylene) stitched along its front edge 62 to the underside of front deck 30 on stitch line 63 disposed transverse to the bed frame's longitudinal axis 29 and adjacent to the rear edge 64 of that front deck. Note the stitch line 63 is disposed within the bed frame's foot section 19, i.e., between the pivot axis 22' defined by pivot points 22 at the pivotal connection of the bed frame's foot section and intermediate section 19 on the one hand and the foot rail 26 on the other hand. The cloth fabric flap 61 is of the same width W as the front deck 30, and extends under the rear deck 40 (when decks 30, 40 are in a coplanar or bed attitude as shown in FIG. 1) toward the bed frame's head section 16 but the free edge 65 does not extend beyond the intermediate section, i.e., is positioned between pivot axis 22' and pivot axis 21' defined by pivot points 21 at the pivotal connection of the bed frame's intermediate section 18 and body section 17. The cloth fabric flap 61 includes, at its free edge 65, a sleeve 66 that runs across the entire width thereof.

A flexible curved wire 67 is received in the flap's sleeve 66, the wire being bolted at its ends, as at 68, 69, to the opposed side rails 18' of the intermediate section 18 of the rear deck frame 16–18. The length of that curved wire element 67 is greater than the transverse distance D between the parallel side rails 18', the curved wire element thereby remaining curved when the bed frame 15 is in the bed attitude shown in FIG. 1 as well as in the sofa attitude shown in FIG. 3. Thus, the wire element 67 is fixed in position at the free edge 65 of the cloth fabric flap 61 by virtue of being received in that flap's sleeve 66. Further, a linear cross tie bar 70 is fixedly connected at its ends 71, 72, to the opposed side rails 19' of the foot section 19 of front deck frame of the bed frame 15. Note particularly the linear cross tie bar 70 is positioned between the front deck 30 and rear deck 40 (when decks 30, 40 are in a coplanar or bed attitude as shown in FIGS. 1 and 1A) and the flap 61, and between the flap's front 62 and free 65 edges, in all operational positions of the bed frame's decks 30, 40 and the tensioning device 60. The curved wire element 67 thus cooperates with cross tie bar 70 to aid in establishing tautness of the front deck 30 when the bed frame 15 is in the sofa attitude illustrated in FIG. 3. Further, the cross tie bar 70 establishes a front edge for the spring like surface provided by cloth deck 30 and tensioning device 60 when the bed frame 15 is folded into the sofa attitude.

Normally, in the use of sofa-sleepers, a foldable mattress rests atop the cloth or wire decks 30, 40 of the bed frame. When the bed frame is folded to the position illustrated in FIG. 3, the mattress is folded upon itself or doubled over within the bed frame, all as more completely described in the above idenified U.S. Pat. No. 3,854,153.

Figures 2, 2A:
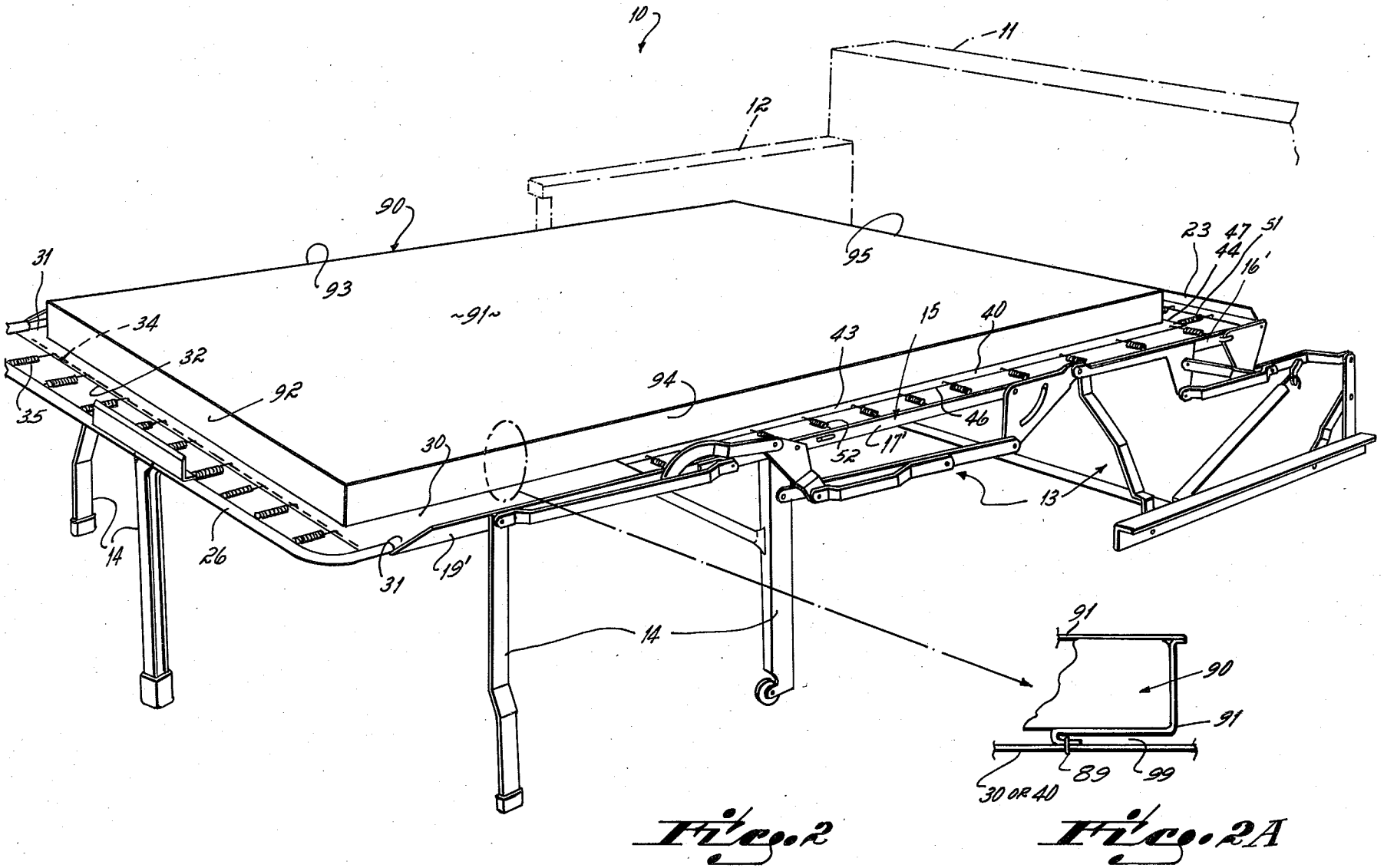
FIG. 2 is a view of the sofa-sleeper of FIG. 1, but showing the bed frame in folded or sofa attitude; the cushions being omitted for clarity of the pertinent structure.
Figure 3:
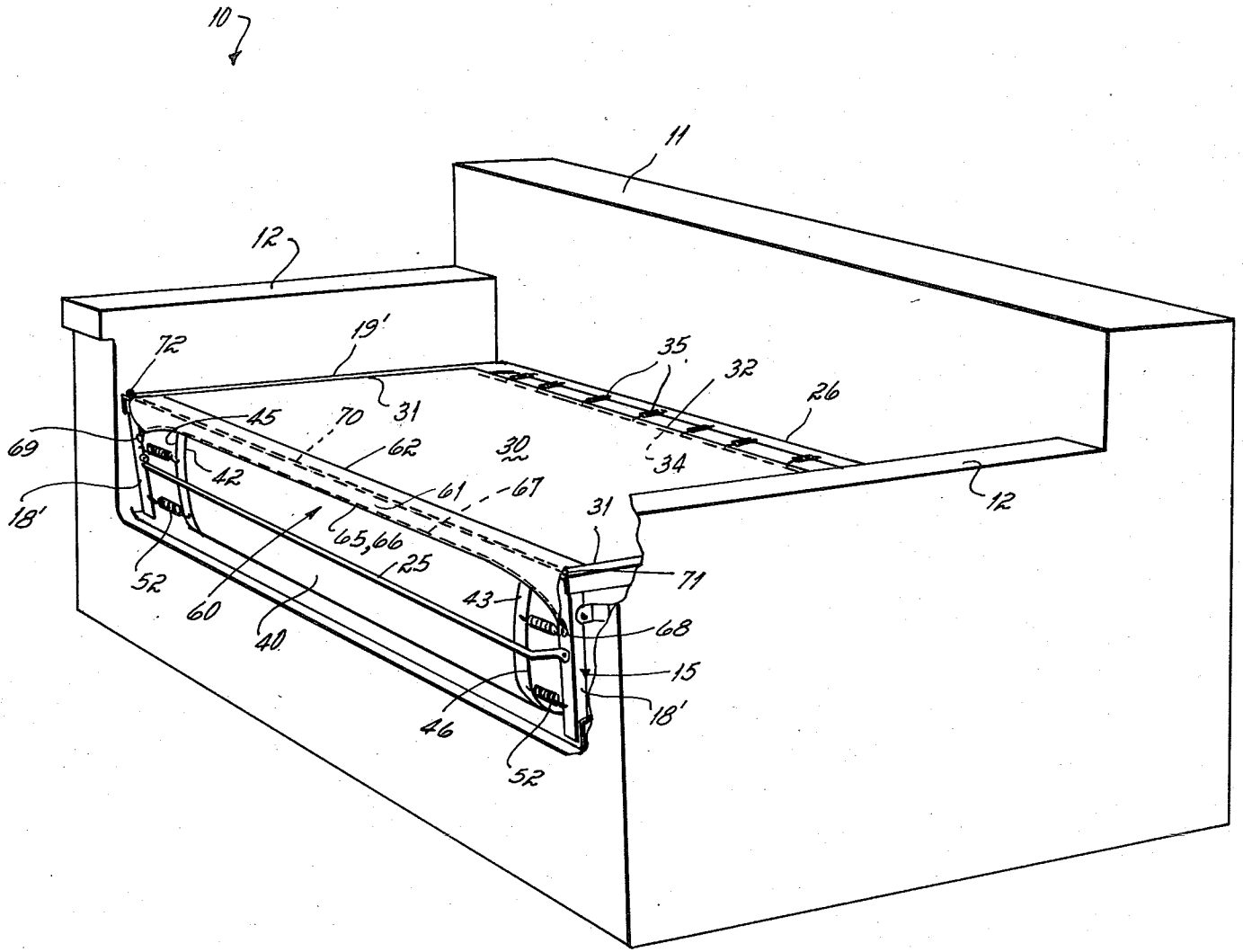
FIG. 3 is a view similar to FIG. 1 but illustrating the mattress stitched in combination with the front and rear cloth decks of the improved sofa-sleeper.

According to the practice of this invention, rather than supporting the mattress loosely on the bed frame, the mattress 90 (FIG. 3) is restrained in position on the front 30 and rear 40 cloth decks when the bed frame 15 is in both the FIG. 1 and in the FIG. 3 attitudes. The mattress 90 structure may be any structure commonly known to the art, and may be, for example, of foam rubber. The mattress 90 structure is preferably enclosed within a cloth covering of envelope 91 that is stitched along stitch line 89 about the entire periphery of the mattress to both the front 30 and rear 40 cloth fabric decks. In other words, the mattress 90 is enclosed within a cloth covering 91, and the cloth covering is stitched along its front 92, sides 93, 94, and rear 95 edges to the front 30 and rear 40 decks of the bed frames. As illustrated in FIG. 3A, the stitch line 89 at the mattress' foot 92, side 93, 94 and head 95 edges is preferably inset a slight distance, e.g., 4", toward the mattress' center from the respective edge of the mattress. This insetting of stitch line 89 for covering envelope 91 relative to the mattress' foot 92 and side 93, 94 and head 95 edges allows bed coverings, e.g., sheets and blanket, to be tucked in when the bed frame 15 is in the bed attitude shown in FIG. 2 by establishing pockets 99 between the mattress 90 and cloth decks 30, 40 along the foot 92 and side 93, 94 and head 95 edges of the mattress.

In use of the improved sofa-sleeper structure illustrated in FIGS. 1, 1A and 3, the bed frame 15 as shown in FIGS. 1 and 1A is in the horizontal or bed attitude. In this attitude, the front bed frame section 19 and the rear bed frame sections 16–18 are restrained in rigid bed frame 15 relation one to another by linkage structure 13, and the front cloth deck 30 and rear cloth deck 40 are restrained in taut relation between the side rails 16'–18' of the bed frame 15, and between head 23 and foot 26 rails of the bed frame, by tension springs 51, 52 and 35, respectively. In this attitude, therefore, the cloth fabric decks 30, 40 provide a spring like surface when the bed frame 15 is used as a bed. And, in this horizontal or bed attitude of the bed frame 15, the tensioning device 60 has no function except that cross tie bar 70 tends to rigidify the front bed frame section 19 since it fixedly interconnects side rails 19' of that frame section. In other words, and in the bed attitude, the cloth fabric flap 61 and spring wire element 67 provide no function. However, in this bed attitude the existence of rear cloth deck 40 in combination with front cloth deck 30 provides better support than that provided by a front cloth deck and a wire grid such as shown in U.S. Pat. No. 3,854,153 in that less sag is established in the head 16, body 17 and intermediate 18 sections of the bed frame 15 during use of the structure as a bed.

When the bed frame 15 is translated from the extended or bed attitude shown in FIG. 1 to the folded or sofa attitude shown in FIG. 3, the foot section 19 is folded relative to the body section 17 into generally parallel relation therewith, intermediate section 18 (through pivot axis 21' and 22') retaining the body section 17 and foot section 19 in connected relation. In this sofa attitude, where the foot section 19 is disposed in generally overlying parallel relation with the body section 17, the tension device 60 serves to aid in establishing and retaining the front cloth deck 30 in a generally taut attitude in that direction parallel to the longitudinal axis 29 of the bed frame 15. In other words, the tension device 60 cooperates with tension springs 35 to aid in drawing the cloth deck 30 taut, across the width W of that cloth deck. This is accomplished, as illustrated in FIG. 3, by cross tie bar 70 defining a rigid front edge (relative to the strength of tension springs 35 and tension wire element 67) so that the tension wire element 67, cooperating with flap 61, tends to draw the cloth deck 30 taut over the rigid front edge defined by that cross tie bar 70. Thus, and in the sofa attitude, the tension wire element 67 cooperates with tension springs 35 to draw the front cloth deck 30 taut over the immobile (relative to the bed frame's foot section 19) cross tie bar 70, thereby establishing a spring like surface for the front cloth deck 30 when that deck is in the sofa attitude.

With the mattress stitched to the fabric cloth decks 30,40 around the entire periphery of that mattress as on stitch line 89 through use of a cloth envelope or covering 91, it is readily appreciated that the mattress is thereby located in relatively stationary fashion on the cloth decks. This combined mattress 90/front 30 and rear 40 cloth deck structure for the sofa-sleeper bed frame 15 provides a couple of significant advantages over structures now known to the prior art. These advantages are based on the fact that the mattress does not shift materially when the bed frame 15 is folded up into the sofa attitude from the bed attitude, or unfolded out from the sofa attitude into the bed attitude. This structure therefore aids in preventing undue stresses from being introduced into the various sections 16–19 of the bed frame, as well as into the linkage structure 13 by which the bed frame 15 is folded and unfolded, due to misalignment of the mattress.

Having described in detail the preferred embodiment of my invention, what I desire to claim and protect by Letters Patent is:

1. An improved sofa-sleeper structure comprising a bed frame having a front bed frame section, an intermediate bed frame section, and a rear bed frame section, said front, intermediate, and rear sections being pivotable relative one to the other between a folded sofa attitude and a flat bed attitude, a cloth front deck fixed to said front deck section, said cloth front deck being connected with the foot rail of said front deck section by a plurality of springs, a cloth rear deck fixed to said rear deck section, said cloth rear deck being connected with the side rails of said rear deck section by a plurality of springs, at least one stitch line fixedly connecting said cloth front deck to said cloth rear deck, said stitch line being disposed generally transverse to the longitudinal axis of said bed frame, and constituting the only direct connection between said front and rear cloth decks, a tensioning device including a cloth flap connecting said intermediate deck frame section with the rear edge of said cloth front deck such that said tensioning device induces tension in said cloth front deck in a longitudinal direction relative to the longitudinal axis of the bed frame when said sofa sleeper structure is in the folded sofa attitude, and said tensioning device induces no tensioning in said cloth front deck when said sofa sleeper structure is in the bed attitude, a one-piece mattress positioned in overlying fashion on said cloth front deck and said cloth rear deck when said bed frame is in the bed attitude, said mattress being doubled over onto itself between said front deck and said rear deck when said bed frame is in the sofa attitude, and connector means connecting said one-piece mattress to said cloth front deck, and connecting said mattress to said cloth rear deck, around at least a portion of the periphery of said mattress, said connector means functioning to generally stabilize said mattress in position relative to said bed frame as said bed frame is translated between the sofa and bed attitudes, said connector means locating said mattress in general bed position when said bed frame is moved from the sofa attitude to the bed attitude for minimizing re-positioning of said mattress on said bed frame prior to use, and said connector means also locating said mattress in sofa position when said bed frame is in the sofa attitude for minimizing undue stress on said linkage structure as said mattress, bed frame and linkage is moved from the bed attitude to the sofa attitude.

2. An improved sofa-sleeper structure as set forth in claim 1, said structure including a cross tie bar which extends between the side edges of said front frame section of said bed frame, said cross tie bar being located between said cloth flap and said cloth rear deck.

3. An improved sofa-sleeper structure as set forth in claim 2, said tensioning device including a sleeve located along the rear edge of said cloth flap, and a tensioning wire located within said sleeve.

4. An improved sofa-sleeper structure as set forth in claim 1, said connector means along the side edges of said mattress being positioned inwardly relative to the center of said mattress from the periphery thereof so as to establish pockets within which a bed covering may be tucked when said bed frame is disposed in a bed attitude, and when said sofa-sleeper is made up as a bed.

5. An improved sofa-sleeper structure as set forth in claim 1, said mattress being connected to said cloth front and said cloth rear decks by stitching said mattress thereto, said mattress stitch lines being generally parallel to those mattress peripheral edges to which said stitch lines are adjacent.

6. An improved sofa-sleeper structure as set forth in claim 5, said connector means including cloth means stitched to said cloth front deck and to said cloth rear deck.

7. An improved sofa-sleeper structure as set forth in claim 6, said cloth means being in the nature of an envelope within which said mattress is positioned.

* * * * *